US011499284B2

(12) United States Patent
Wang et al.

(10) Patent No.: US 11,499,284 B2
(45) Date of Patent: Nov. 15, 2022

(54) TROUGH PLATE FOR CONSTRUCTING LOCKED POLYMER ANTI-SEEPAGE WALL AND CONSTRUCTION METHOD OF LOCKED POLYMER ANTI-SEEPAGE WALL

(71) Applicants: Zhengzhou University, Henan (CN); Henan Institute of Sun Yat-sen University, Henan (CN)

(72) Inventors: Fuming Wang, Henan (CN); Chengchao Guo, Henan (CN); Chaojie Wang, Henan (CN); Mingsheng Shi, Henan (CN); Peng Zhao, Henan (CN); Yanhui Pan, Henan (CN); Xianfeng Zhao, Henan (CN); Binghan Xue, Henan (CN); Yanjie Hao, Henan (CN); Xijun Zhang, Henan (CN); Yangyang Xia, Henan (CN); Yingli Wang, Henan (CN)

(73) Assignees: Zhengzhou University, Henan (CN); Henan Institute of Sun Yat-sen University, Henan (CN)

( * ) Notice: Subject to any disclaimer, the term of this patent is extended or adjusted under 35 U.S.C. 154(b) by 0 days.

(21) Appl. No.: 17/334,701

(22) Filed: May 29, 2021

(65) Prior Publication Data

US 2021/0285180 A1 Sep. 16, 2021

(30) Foreign Application Priority Data

May 30, 2020 (CN) ..... 202010479555.4

(51) Int. Cl.
*E02D 5/14* (2006.01)
*E02D 19/12* (2006.01)
(Continued)

(52) U.S. Cl.
CPC ..... *E02D 5/14* (2013.01); *E02B 3/16* (2013.01); *E02D 5/12* (2013.01); *E02D 5/38* (2013.01);
(Continued)

(58) Field of Classification Search
CPC ..... E02D 5/14; E02D 19/12
(Continued)

(56) References Cited

U.S. PATENT DOCUMENTS 4,909,674 A * 3/1990 Konno ..... E02D 19/18 405/266
4,981,540 A * 1/1991 Prochhorst ..... E02D 5/14 405/278
(Continued)

FOREIGN PATENT DOCUMENTS

CN 105804107 A * 7/2016 ..... E02D 5/14
CN 110499766 A * 11/2019 ..... E02D 15/04
(Continued)

*Primary Examiner* — Frederick L Lagman

(57) ABSTRACT

A trough plate for constructing a locked polymer anti-seepage wall includes a plate body, a guide tube, a grouting pipe and an anti-blocking head. A construction method of the locked polymer anti-seepage wall includes the steps of positioning an $N^{th}$ trough plate and then pressing the $N^{th}$ trough plate into ground, wherein N is a natural number larger than and equal to 1; engaging an $(N+1)^{th}$ trough plate with the $N^{th}$ trough plate, and then pressing the $(N+1)^{th}$ trough plate into the ground; connecting a grouting pipe of the $N^{th}$ trough plate with a grouting machine, pulling out the $N^{th}$ trough plate, and simultaneously grouting through the grouting pipe of the $N^{th}$ trough plate by the grouting machine; and repeating the steps (B) and (C) till the locked polymer anti-seepage wall is completed, wherein the steps (B) and (C) are repeated every time, N is automatically increased by 1.

8 Claims, 3 Drawing Sheets

(51) Int. Cl.

| | |
|---|---|
| ***E02B 3/16*** | (2006.01) |
| ***E02D 5/12*** | (2006.01) |
| ***E02D 5/38*** | (2006.01) |
| ***E02D 7/18*** | (2006.01) |
| ***E02D 31/02*** | (2006.01) |

(52) U.S. Cl.
CPC ..... *E02D 7/18* (2013.01); *E02D 19/12* (2013.01); *E02D 31/02* (2013.01); *E02D 2250/003* (2013.01); *E02D 2300/0006* (2013.01); *E02D 2300/0018* (2013.01); *E02D 2600/20* (2013.01)

(58) Field of Classification Search
USPC ..... 405/266, 270, 279
See application file for complete search history.

(56) References Cited

U.S. PATENT DOCUMENTS

| | | | | | |
|---|---|---|---|---|---|
| 5,782,583 | A * | 7/1998 | Vales | E02D 5/04 | 405/281 |
| 5,938,375 | A * | 8/1999 | Wheeler, Jr. | E02D 5/06 | 405/152 |
| 6,554,544 | B1 * | 4/2003 | Barkasz | E02D 19/18 | 405/274 |
| 8,272,811 | B2 * | 9/2012 | Wang | E02D 19/16 | 405/116 |
| 9,080,300 | B2 * | 7/2015 | Wang | E02D 3/00 | |
| 11,136,738 | B2 * | 10/2021 | Trout | E02D 5/72 | |
| 2014/0314498 | A1 * | 10/2014 | Wang | E02D 19/12 | 405/266 |

FOREIGN PATENT DOCUMENTS

| | | | | |
|---|---|---|---|---|
| GB | 2322658 | A * | 9/1998 | E02D 5/14 |
| JP | 56131711 | A * | 10/1981 | |
| JP | 58110713 | A * | 7/1983 | |
| KR | 20150098135 | A * | 8/2015 | |

* cited by examiner

TROUGH PLATE FOR CONSTRUCTING LOCKED POLYMER ANTI-SEEPAGE WALL AND CONSTRUCTION METHOD OF LOCKED POLYMER ANTI-SEEPAGE WALL

CROSS REFERENCE OF RELATED APPLICATION

The present invention claims priority under 35 U.S.C. 119(a-d) to CN 202010479555.4, filed May 30, 2020.

BACKGROUND OF THE PRESENT INVENTION

Field of Invention

The present invention relates to the field of anti-seepage reinforcement technology, and more particularly to a trough plate for constructing a locked polymer anti-seepage wall and a construction method of the locked polymer anti-seepage wall. The locked polymer anti-seepage wall is adapted for anti-seepage reinforcement of water conservancy infrastructure such as dams and reservoirs, and of underground space engineering such as foundation pits and subways.

Description of Related Arts

In recent years, China's water conservancy, mining, construction and other infrastructure construction have made remarkable achievements. In terms of water conservancy infrastructure, the total length of embankments in China has reached 410,000 kilometers, and more than 98,000 reservoirs have been built, which is an important part of the field of flood control and disaster reduction in China. However, the construction of embankments in China has a long history, which has experienced years of thickening, insufficient construction quality, many hidden dangers, complex geological conditions, and frequent flood risks. Similarly, the risk rate of built reservoirs is 57.1%, and most of the small and medium-sized reservoirs need anti-seepage reinforcement. Once these water conservancy facilities fail, the impact is significant, which poses a serious threat to the safety of people's lives and property. Therefore, it is urgent to improve the anti-seepage reinforcement technology and equipment level of water conservancy infrastructure.

At present, the existing anti-seepage reinforcement technologies include concrete cutoff wall technology, cement-soil mixing pile technology, and high-pressure jet grouting technology. However, the common problems of these technologies include large disturbance damage to dams, long construction period, insufficient efficiency, large construction equipment, and large wall thickness, which limit further application of these existing technologies. Currently, the polymer grouting technology has been widely used in water conservancy, mining, transportation and other fields, which utilizes the characteristics of rapid reaction and rapid expansion of polymer to inject the polymer into cracks or holes, so as to achieve the purpose of anti-seepage and plugging. In recent years, in view of the shortcomings of the current anti-seepage reinforcement technology of dams and reservoirs in China, starting from the concept of flexible anti-seepage, the inventor of the present invention has applied for some utility patents such as the polymer curtain grouting technology, the directional fracturing grouting method of dam using anti-seepage polymer, and the forming method of ultra-thin polymer anti-seepage wall. Among them, the ultra-thin polymer anti-seepage wall technology includes forming multiple slots under static pressure and then grouting to form a continuous and uniform anti-seepage wall. However, the technology is greatly affected by geological conditions, and it is difficult to construct in soil containing impurities such as gravel. While forming the slots with a conical head, the conical head is not enough in stiffness, so that it is easy to produce deflection, and accordingly, problems such as insufficient continuity of anti-seepage body will occur while grouting.

SUMMARY OF THE PRESENT INVENTION

In view of the above-mentioned problems and deficiencies, an object of the present invention is to provide a trough plate for constructing a locked polymer anti-seepage wall and a construction method of the locked polymer anti-seepage wall. The trough plate is simple and fast in operation, is not affected by geological conditions, is good in wall-forming effect and is strong is continuity. Moreover, the trenching equipment is able to be reused. The present invention solves the problems in the construction process of polymer anti-seepage wall that slots are easy to deviate, the trough plates for constructing the polymer anti-seepage wall are difficult to be engaged with each other, the slot depth is insufficient, and the polymer anti-seepage wall is insufficient in continuity due to foregoing deficiencies.

Accordingly, to achieve the above object, the present invention provides technical solutions as follows.

A trough plate for constructing a locked polymer anti-seepage wall comprises:

a plate body;

a guide tube which is arranged along a longitudinal direction of the plate body;

a grouting pipe is coaxially provided within the guide tube, wherein two sealing plugs are provided at two ends of the grouting pipe for filling gaps between the grouting pipe and the guide tube, respectively; and an anti-blocking head which is sleeved to a lower portion of the guide tube.

Preferably, a lower end of the anti-blocking head is cone-shaped, a counterbore is provided in a middle portion of the anti-blocking head for allowing the anti-blocking head to be sleeved to the guide tube.

Preferably, an avoidance notch is provided on the plate body for matching with the anti-blocking head, two stoppers are respectively provided at two sides of the guide tube for fixing the anti-blocking head.

Preferably, the two sealing plugs, having a cone-shaped structure and made from rigid plastics, are matched with both the grouting pipe and the guide tube.

Preferably, the plate body comprises a support plate, a first locking lug and a second locking lug both of which are located at two sides of the support plate, respectively.

Also, the present invention provides a construction method of the locked polymer anti-seepage wall, which adopts multiple foregoing trough plates to construct the locked polymer anti-seepage wall. The construction method comprises the steps of:

(A) positioning an $N^{th}$ trough plate and then pressing the $N^{th}$ trough plate into ground, wherein N is a natural number larger than and equal to 1;

(B) engaging an $(N+1)^{th}$ trough plate with the $N^{th}$ trough plate, and then pressing the $(N+1)^{th}$ trough plate into the ground;

(C) connecting a grouting pipe of the $N^{th}$ trough plate with a grouting machine, pulling out the $N^{th}$ trough plate, and simultaneously grouting through the grouting pipe of the $N^{th}$ trough plate by the grouting machine; and (D) repeating the steps (B) and (C) till the locked polymer anti-seepage wall is completed, wherein the steps (B) and (C) are repeated every time, N is automatically increased by 1.

Further, the $N^{th}$ trough plate and the $(N+1)^{th}$ trough plate are pressed into the ground by a pile driver installed with a vibratory hammer.

Further, in the step (C), after pulling out the $N^{th}$ trough plate for 10 to 50 cm, grouting through the grouting pipe of the $N^{th}$ trough plate by the grouting machine, and simultaneously slowly pulling out the $N^{th}$ trough plate by high-frequency vibration.

Also, the present invention provides another construction method of the locked polymer anti-seepage wall, which is similar to the construction method mentioned above. The construction method comprises the steps of:

(A) positioning a first trough plate and then pressing the first trough plate into ground;

(B) engaging a second trough plate with the first rough plate, and then pressing the second tough plate into the ground;

(C) connecting a grouting pipe of the first tough plate with a grouting machine, pulling out the first tough plate, and simultaneously grouting through the grouting pipe of the first tough plate by the grouting machine, wherein during grouting, an original anti-blocking head and an original sealing plug of the first tough plate automatically fall off;

(D) replacing an original grouting pipe of the first tough plate with a new grouting pipe, and installing a new anti-blocking head and a new sealing plug to a plate body of the first tough plate;

(E) engaging the first tough plate with the second rough plate, and then pressing the first tough plate into the ground;

(F) connecting a grouting pipe of the second rough plate with the grouting machine, pulling out the second trough plate, and simultaneously grouting through the grouting pipe of the second trough plate by the grouting machine, wherein during grouting, an original anti-blocking head and an original sealing plug of the second tough plate automatically fall off;

(G) replacing an original grouting pipe of the second tough plate with a new grouting pipe, and installing a new anti-blocking head and a new sealing plug to a plate body of the second tough plate; and (H) repeating the steps (B) to (G) till the locked polymer anti-seepage wall is completed.

Through the foregoing technical solutions, the present invention has some beneficial effects as follows.

The trenching device is able to be reused. The construction method is simple and fast, is not affected by geological conditions, and has good wall-forming effect. The locked polymer anti-seepage wall provided by the present invention has strong continuity. The construction method resolves the problem that during the construction process of the polymer anti-seepage wall, the trough plates for constructing the polymer anti-seepage wall are difficult to be engaged with each other, and the slot depth is insufficient under complex geological conditions.

By designing the assembly structure of the guide tube and the grouting pipe in the present invention, the soil or slurry is avoided from entering the guide tube during the pressing process or the grouting process, thereby making it easier to replace the grouting pipe and clean the guide tube. Moreover, during the construction process, the trough plate is able to be reused, avoiding a trough plate is unable to be used due to the blockage of the grouting pipe or the guide tube thereof and the construction process is affected, thus improving the construction quality.

According to the preferred embodiment of the present invention, the anti-blocking head is sleeved to a lower portion of the guide tube for protecting the guide tube and the grouting pipe in the pressing process of the trough plate, so as to avoid the soil entering the guide tube or the grouting pipe. During the grouting process, the anti-blocking head automatically falls off from the guide tube when the trough plate is pulled out, which does not affect the grouting, so that the failure of the entire operation process is reduced and the smoothness of the entire operation process is ensured, thus the entire construction efficiency is effectively guaranteed and improved.

BRIEF DESCRIPTION OF THE DRAWINGS

In order to clarify the technical solutions of the present invention more clearly, the drawings of the present invention are briefly introduced as below. It should be understood that the drawings are used only to show some embodiments of the present invention, not the limitation of the present invention.

Figure 1:
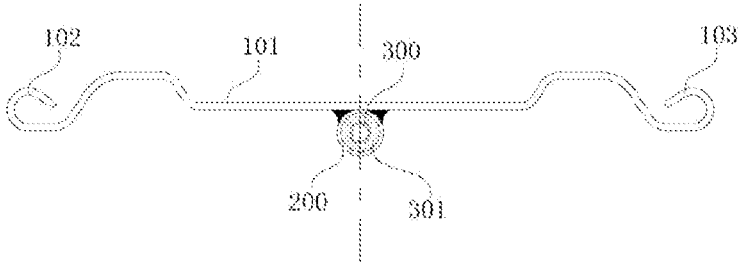
FIG. 1 is a top view of a trough plate for constructing a locked polymer anti-seepage wall according to a preferred embodiment of the present invention.

In the drawings, 100: plate body; 101: support plate; 102: first locking lug; 103: second locking lug; 200: guide tube; 300: grouting pipe; 301: sealing plug; 400: anti-blocking head; 401: stopper; 402: counterbore; 403: avoidance notch; 500: pile driver; 600: locked polymer anti-seepage wall.

DETAILED DESCRIPTION OF THE PREFERRED EMBODIMENT

The embodiments of the present invention will be described clearly and completely in combination with the accompanying drawings as follows. Unless otherwise defined, the technical or scientific terminologies used in the present invention shall be understood by those skilled in the art.

It should be noted that when an element is "connected", "coupled" or "communicated" with another element, it means that the element is directly connected, coupled or communicated with the another element; also, the element is able to be connected, coupled or communicated with the another element through one or more intermediate elements.

It should be noted that the use of "one" and other quantifiers does not necessarily mean a quantitative restriction. "Include", "comprise" and other similar words mean that the element or item appearing before these words encompasses elements or items listed after these words, and does not exclude other elements or items.

It should be noted that terminologies indicating the orientation or positional relationship such as "upper", "lower", "left" and "right" are only used to indicate the relative positional relationship, which is intended to facilitate the description of the present invention, and not that the device or element must have a specific orientation, be constructed and operated in a specific orientation. When the absolute position of the described object changes, the relative position relationship may also change accordingly.

Referring to FIGS. 1 to 5, a trough plate for constructing a locked polymer anti-seepage wall according to a preferred embodiment of the present invention is illustrated, which comprises a plate body 100, a guide tube 200, a grouting pipe 300 and an anti-blocking head 400, wherein the plate body 100 comprises a support plate 101, a first locking lug 102 and a second locking lug 103 both of which are located at two sides of the support plate 101, respectively; the guide tube 200 is arranged along a longitudinal direction of the plate body 100; the grouting pipe 300 is coaxially provided within the guide tube 200; two sealing plugs 301 are provided at two ends of the grouting pipe 300 for filling gaps between the grouting pipe 300 and the guide tube 200, respectively; the anti-blocking head 400 is sleeved to a lower portion of the guide tube 200.

Preferably, a lower end of the anti-blocking head 400 is cone-shaped, a counterbore 402 is provided in a middle portion of the anti-blocking head 400 for allowing the anti-blocking head 400 to be sleeved to the guide tube 200, an avoidance notch 403 is provided on the plate body 100 for matching with the anti-blocking head 400, two stoppers 401 are respectively provided at two sides of the guide tube 200 for fixing the anti-blocking head 400.

The two sealing plugs 301, having a cone-shaped structure and made from rigid plastics, are matched with both the grouting pipe 300 and the guide tube 200.

Also, the present invention discloses a construction method of a locked polymer anti-seepage wall, which adopts multiple foregoing trough plates to construct the locked polymer anti-seepage wall. The construction method comprises the steps of:

(A) positioning an $N^{th}$ trough plate and then pressing the $N^{th}$ trough plate into ground, wherein N is a natural number larger than and equal to 1;

(B) engaging an $(N+1)^{th}$ trough plate with the $N^{th}$ trough plate, and then pressing the $(N+1)^{th}$ trough plate into the ground;

(C) connecting a grouting pipe of the $N^{th}$ trough plate with a grouting machine, pulling out the $N^{th}$ trough plate, and simultaneously grouting through the grouting pipe of the $N^{th}$ trough plate by the grouting machine; and (D) repeating the steps (B) and (C) till the locked polymer anti-seepage wall is completed, wherein the steps (B) and (C) are repeated every time, N is automatically increased by 1.

Further, the $N^{th}$ trough plate and the $(N+1)^{th}$ trough plate are pressed into the ground by a pile driver installed with a vibratory hammer.

Further, in the step (C), after pulling out the $N^{th}$ trough plate for 10 to 50 cm, grouting through the grouting pipe of the $N^{th}$ trough plate by the grouting machine, and simultaneously slowly pulling out the $N^{th}$ trough plate by high-frequency vibration.

Also, the present invention provides another construction method of the locked polymer anti-seepage wall, which is similar to the construction method mentioned above. The construction method comprises the steps of:

(A) positioning a first trough plate and then pressing the first trough plate into ground;

(B) engaging a second trough plate with the first rough plate, and then pressing the second tough plate into the ground;

(C) connecting a grouting pipe of the first tough plate with a grouting machine, pulling out the first tough plate, and simultaneously grouting through the grouting pipe of the first tough plate by the grouting machine, wherein during grouting, an original anti-blocking head and an original sealing plug of the first tough plate automatically fall off;

(D) replacing an original grouting pipe of the first tough plate with a new grouting pipe, and installing a new anti-blocking head and a new sealing plug to a plate body of the first tough plate;

(E) engaging the first tough plate with the second rough plate, and then pressing the first tough plate into the ground;

(F) connecting a grouting pipe of the second rough plate with the grouting machine, pulling out the second trough plate, and simultaneously grouting through the grouting pipe of the second trough plate by the grouting machine, wherein during grouting, an original anti-blocking head and an original sealing plug of the second tough plate automatically fall off;

(G) replacing an original grouting pipe of the second tough plate with a new grouting pipe, and installing a new anti-blocking head and a new sealing plug to a plate body of the second tough plate; and (H) repeating the steps (B) to (G) till the locked polymer anti-seepage wall is completed.

Related components are further described with the specific construction method as follows.

Figure 2:
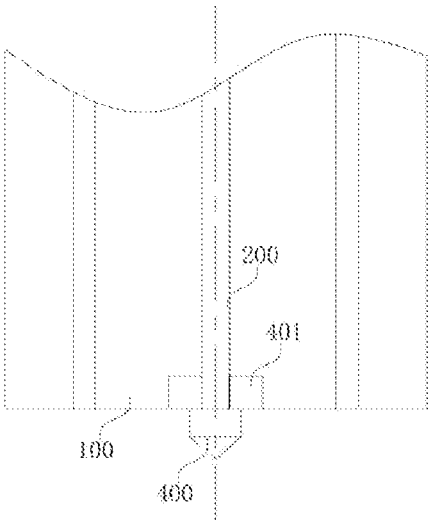
FIG. 2 is a front view of the trough plate for constructing the locked polymer anti-seepage wall according to the above preferred embodiment of the present invention.
Figure 3:
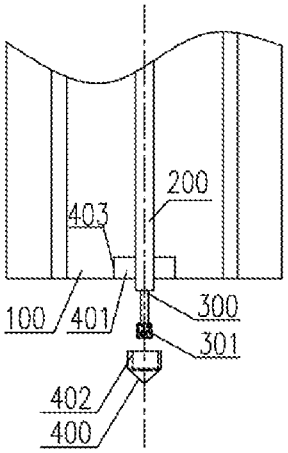
FIG. 3 is an exploded view of the trough plate for constructing the locked polymer anti-seepage wall according to the preferred embodiment of the present invention.
Figure 4:
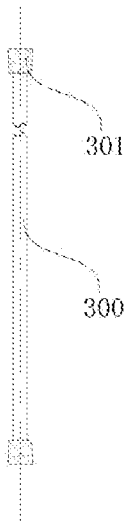
FIG. 4 is an assembly drawing of the trough plate for constructing the locked polymer anti-seepage wall according to the preferred embodiment of the present invention.
Figure 5:
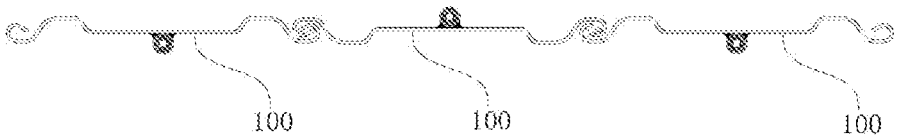
FIG. 5 shows multiple trough plates for constructing the locked polymer anti-seepage wall are engaged with each other.
Figure 6:
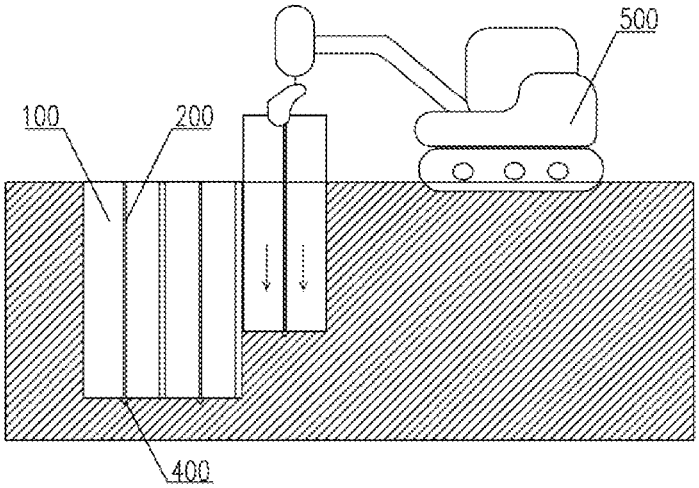
FIG. 6 shows that the trough plates are pressed into ground.

(1) The specific structure of the trough plate:

Referring to FIGS. 1 and 2, a hollow steel tube with a diameter of 5 cm as a guide tube, is directly welded to a back of a plate body, a grouting pipe with a diameter of 8 mm is provided within the guide tube.

The rigid plastics are provided at two ends of the grouting pipe for filling gaps between the grouting pipe and the guide tube, respectively, so as to avoid blocking the grouting pipe and the guide tube which is caused by slurry flowing back to the gaps during grouting.

In order to prevent the soil from entering the grouting pipe in the process of pressing, an anti-blocking head having a cone-shaped hollow structure, is installed at the bottom of the guide pipe. The anti-blocking head is indirectly adhered with the plate body and the grouting pipe. An incision with a width as same as a diameter of the anti-blocking head is formed on the plate body. Two iron blocks or two iron rings are respectively welded at two sides of the guide tube for forming two stoppers for fixing the anti-blocking head. The plate body is a steel board, the guide tube is a steel tube. When the trough plate is pressed into the ground, the anti-blocking head is tightly connected with the guide tube under an action of reaction force for preventing the soil from entering and blocking the grouting pipe. During the process of lifting the trough plate, the anti-blocking head automatically falls, so that the slurry is smoothly injected into the slots for forming the polymer anti-seepage wall.

(2) Press-in or pull-out equipment:

According to the preferred embodiment of the present invention, the trough plate is clamped by a pile driver installed with a vibratory hammer, and then a bottom portion of the trough plate is pressed into the ground by high-frequency vibration.

(3) Construction method of the locked polymer anti-seepage wall:

After the first assembled trough plate is pressed into the ground, the second trough plate is engaged with the first trough plate by locking lugs, and then in the same way, the second trough plate and the third trough plate are successively pressed into the ground.

Figure 7:
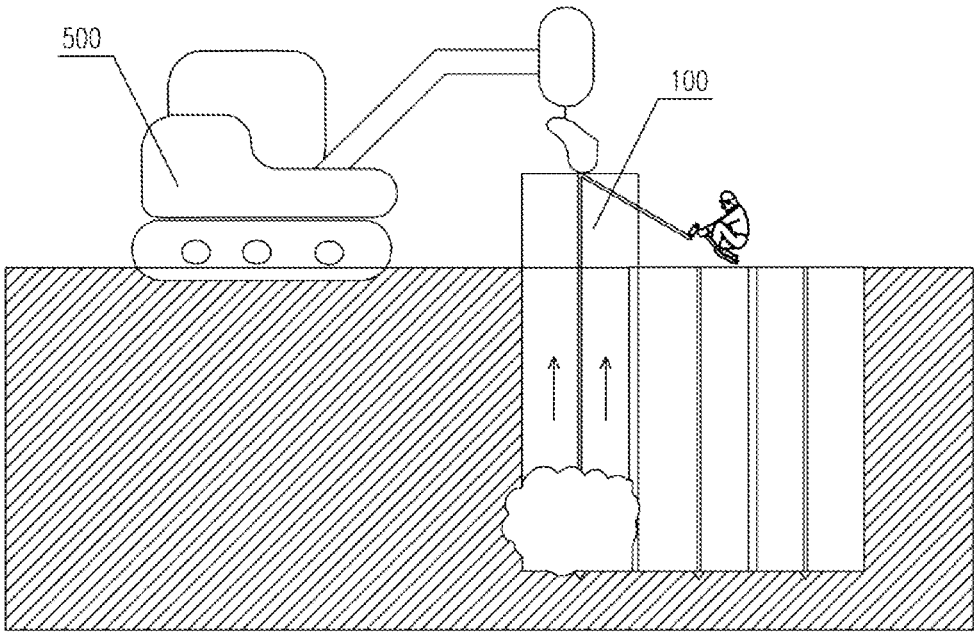
FIG. 7 shows that the trough plates are pulled out from the ground.

The grouting pipe of the first trough plate is connected with the grouting machine, and then the first trough plate is slowly pulled out by the pile driver. When the first trough plate is pulled out for 30 cm, the grouting machine is turning on to start grouting. At this time, while grouting, the first trough plate is slowly pulled out by high-frequency vibration, referring to FIG. 7.

After completing pulling out the first trough plate, the second trough plate is pulled out in a same way.

And then the original grouting pipe of the first trough plate is replaced by a new grouting pipe shown in FIGS. 1 and 2, and then the first trough plate with the new grouting pipe is engaged with the third trough plate, and then the first trough plate is pressed into the ground.

Figure 8:
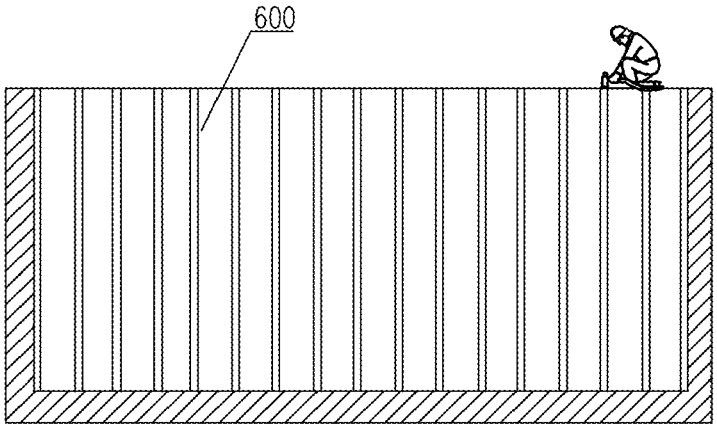
FIG. 8 is a front view of the locked polymer anti-seepage wall according to the preferred embodiment of the present invention.
Figure 9:
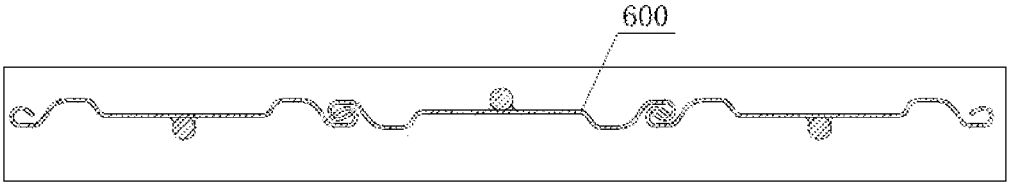
FIG. 9 is a top view of the locked polymer anti-seepage wall according to the preferred embodiment of the present invention.

The above steps are repeated till the locked polymer anti-seepage wall is completed, FIGS. 8 and 9 show the complete locked polymer anti-seepage wall.

The exemplary embodiments of the present invention have been described in detail above. However, those skilled in the art should understand that, these embodiments are merely examples and are not limit the protective scope, application and construction of the present invention in any way. The protective scope of the present invention is limited by the attached claims and equivalents thereof. Many changes to the foregoing embodiments are able to be made by those skilled in the art under the teaching of the present invention, and these changes fall within the protective scope of the present invention.

What is claimed is:

1. A trough plate for constructing a locked polymer anti-seepage wall, the trough plate comprising:

a plate body;

a guide tube which is arranged along a longitudinal direction of the plate body;

a grouting pipe is coaxially provided within the guide tube, wherein two sealing plugs are provided at two ends of the grouting pipe for filling gaps between the grouting pipe and the guide tube, respectively; and an anti-blocking head which is sleeved to a lower portion of the guide tube, wherein an avoidance notch is provided on the plate body for matching with the anti-blocking head, two stoppers are respectively provided at two sides of the guide tube for fixing the anti-blocking head.

2. The trough plate according to claim 1, wherein a lower end of the anti-blocking head is cone-shaped, a counterbore is provided in a middle portion of the anti-blocking head for allowing the anti-blocking head to be sleeved to the guide tube.

3. The trough plate according to claim 1, wherein the two sealing plugs, having a cone-shaped structure and made from rigid plastics, are matched with both the grouting pipe and the guide tube.

4. The trough plate according to claim 1, wherein the plate body comprises a support plate, a first locking lug and a second locking lug both of which are located at two sides of the support plate, respectively.

5. A construction method of the locked polymer anti-seepage wall according to claim 1, wherein the construction method comprises the steps of:

(A) positioning an $N^{th}$ trough plate and then pressing the $N^{th}$ trough plate into ground, wherein N is a natural number larger than and equal to 1;

(B) engaging an $(N+1)^{th}$ trough plate with the $N^{th}$ trough plate, and then pressing the $(N+1)^{th}$ trough plate into the ground;

(C) connecting a grouting pipe of the $N^{th}$ trough plate with a grouting machine, pulling out the $N^{th}$ trough plate, and simultaneously grouting through the grouting pipe of the $N^{th}$ trough plate by the grouting machine; and (D) repeating the steps (B) and (C) till the locked polymer anti-seepage wall is completed, wherein the steps (B) and (C) are repeated every time, N is automatically increased by 1.

6. The construction method according to claim 5, wherein the $N^{th}$ trough plate and the $(N+1)^{th}$ trough plate are pressed into the ground by a pile driver installed with a vibratory hammer.

7. The construction method according to claim 5, wherein in the step (C), after pulling out the $N^{th}$ trough plate for 10 to 50 cm, grouting through the grouting pipe of the $N^{th}$ trough plate by the grouting machine, and simultaneously slowly pulling out the $N^{th}$ trough plate by high-frequency vibration.

8. A construction method of the locked polymer anti-seepage wall according to claim 1, wherein the construction method comprises the steps of:

(A) positioning a first trough plate and then pressing the first trough plate into ground;

(B) engaging a second trough plate with the first trough plate, and then pressing the second trough plate into the ground;

(C) connecting a grouting pipe of the first trough plate with a grouting machine, pulling out the first trough plate, and simultaneously grouting through the grouting pipe of the first trough plate by the grouting machine, wherein during grouting, an original anti-blocking head and an original sealing plug of the first trough plate automatically fall off;

(D) replacing an original grouting pipe of the first trough plate with a new grouting pipe, and installing a new anti-blocking head and a new sealing plug to a plate body of the first trough plate;

(E) engaging the first trough plate with the second trough plate, and then pressing the first trough plate into the ground;

(F) connecting a grouting pipe of the second trough plate with the grouting machine, pulling out the second trough plate, and simultaneously grouting through the grouting pipe of the second trough plate by the grouting machine, wherein during grouting, an original anti-blocking head and an original sealing plug of the second trough plate automatically fall off;

(G) replacing an original grouting pipe of the second trough plate with a new grouting pipe, and installing a new anti-blocking head and a new sealing plug to a plate body of the second trough plate; and (H) repeating the steps (B) to (G) till the locked polymer anti-seepage wall is completed.

* * * * *